United States Patent [19]

Fisher et al.

[11] 3,936,253

[45] Feb. 3, 1976

[54] APPARATUS FOR MELT-SPINNING SYNTHETIC FIBERS

[75] Inventors: William Bernard Fisher; Dong Wha Kim, both of Chester; Orin Wyatt Norwood, Richmond, all of Va.; John Walter Showers, Raleigh, N.C.; Eugene Addison Swanson, Disputanta; Gene Clyde Weedon, Richmond, both of Va.

[73] Assignee: Allied Chemical Corporation, New York, N.Y.

[22] Filed: Dec. 10, 1974

[21] Appl. No.: 531,261

Related U.S. Application Data

[62] Division of Ser. No. 473,260, May 24, 1974.

[52] U.S. Cl. ..... 425/72 S; 425/66

[51] Int. Cl.[2] ..... D01D 3/00

[58] Field of Search ..... 425/72 S, 464; 264/176 F

[56] References Cited

UNITED STATES PATENTS

| | | | |
|---|---|---|---|
| 2,982,994 | 5/1961 | Fernstrom | 425/72 S X |
| 3,070,839 | 1/1963 | Thompson | 425/72 S |
| 3,274,644 | 9/1966 | Massey et al. | 425/72 S |
| 3,335,210 | 8/1967 | Vinicki | 425/464 X |
| 3,336,634 | 8/1967 | Brownley et al. | 425/72 S |
| 3,460,200 | 8/1969 | Zaitsev et al. | 425/72 S X |

*Primary Examiner*—Robert D. Baldwin
*Attorney, Agent, or Firm*—Fred L. Kelly

[57] ABSTRACT

An improved process and apparatus for production of synthetic multifilamentary yarns having uniform quality. The method comprises extruding a molten synthetic polymer downwardly through a spinneret, advancing the extruded filaments downwardly through a substantially stationary column of heated air, and subsequently advancing the filaments downwardly through a quenching zone wherein they are in contact with cooling air introduced into the path of the filaments under controlled conditions of air velocity and direction of flow. The apparatus for carrying out the process comprises an extrusion spinneret for extruding a number of filaments directly into a heated sleeve having walls that are imperforate, said heated sleeve leading to a quenching chamber having opposite, essentially vertical inlet and outlet panels for allowing cooling air to pass through the chamber, and means for regulating the stream of cooling air whereby both the velocity of the air stream going through the quenching chamber and its general direction as it contacts the descending filaments may be regulated.

4 Claims, 4 Drawing Figures

APPARATUS FOR MELT-SPINNING SYNTHETIC FIBERS

This is a division of application Ser. No. 473,260, filed May 24, 1974.

BACKGROUND OF THE INVENTION

This invention relates to an improved apparatus for production of synthetic multifilamentary yarns having uniform quality from high molecular weight linear polymers, in particular polyesters, according to an improved melt spinning process.

An important area of use of such synthetic multifilamentary yarns is the production of tire cord. A number of high polymers are well suited for this utility, especially polyesters and polyamides; however, in the following description reference will be made particularly to filaments of polyethylene terephthalate.

Since tire cord and the structures formed from it are among the essential construction elements for the safety and useful life of a tire, high quality requirements are naturally placed on such endless filaments. In view of the alternating stretching and compression stresses which tires experience in operation, a necessary precondition for the use of synthetic multifilamentary yarns for tire cord is an adequate fatigue resistance of the filaments. For optimum results, it is critical that the individual filaments be substantially uniform. Accordingly, it is common practice to determine the coefficient of variation of the evenness of the yarn (U %) using an Uster evenness tester as manufactured by the Zellweger Company of Uster, Switzerland, and described in "Handbood of Textile Testing and Quality Control" by E. Groover and D. S. Hamby.

Polyethylene terephthalate has come into strong prominence in the last few years for use in tire cord production. Polyethylene terephthalate unfortunately undergoes a considerable thermal decomposition between the conclusion of the production of the spinning raw material (raw polymer melt) and its subsequent shaping into threads. This thermal decomposition can be reduced if the molten spinning raw material is maintained for as short a time and at as low a temperature as possible. However, the residence time of the spinning melt in the spinning apparatus is prescribed by the dimensions of the apparatus, and the lower limit of the spinning temperature is determined by the highly undesirable condition of melt fracture. Where melt fracture occurs, the spun, unstretched filaments do not have a smooth or even surface, and exhibit fluctuations in diameter which are unacceptable for use in tire cord.

It is evident from this that the spinning requirements are diametrically opposed. On the one hand, low melt temperature is required for low decomposition, and on the other hand, high spinning temperature is required for trouble-free spinning. It has been suggested that this problem may be overcome by supplying the polymer melt for melt spinning at a temperature below the spinning temperature and heating the melt prior to filament formation. Normally, the required increase in the temperature of the melt is accomplished by use of a spinning assembly that includes a spinning filter disposed upstream of the spinneret plate, the pressure drop across said spinning filter being at least about 150 atmospheres.

Unfortunately, the polyester yarn made in accordance with known processes is not completely satisfactory. In particular, fused filaments and excessive variation in the evenness of filaments (U %) has been noted when the polymer melt is extruded through the spinneret at a rate of about 50 pounds per hour or greater. Problems in fiber uniformity have been particularly troublesome in so-called double-end melt spinning of synthetic fibers, i.e., using one spin pot to feed both sides of a "split" spinneret. Accordingly, research has been continued in an effort to solve these deficiencies.

SUMMARY OF THE INVENTION

The present invention relates to an improved apparatus for preparing synthetic multifilamentary yarns having uniform quality. The process may be summarized as follows:

In a process for the production of a synthetic multifilamentary yarn from a high-molecular weight thermoplastic polymer, selected from the group consisting of linear polyester and polyamide polymers, by melt-spinning, including the steps of supplying a melt of said polymer at a temperature below the spinning temperature, and heating the melt to spinning temperature prior to filament formation, the improvement which comprises:

a. extruding the molten synthetic polymer at a rate of at least 50 pounds per hour downwardly through a spinneret having a plurality of extrusion orifices.

b. advancing the extruded filaments downwardly through a substantially stationary column of air having a temperature of 100° to 330°C. immediately below the spinneret, the average distance between adjacent filaments immediately below the spinneret being at least 0.24 inch, preferably 0.28 to 0.4 inch; and c. subsequently advancing the filaments downwardly through a quenching zone wherein they are in contact with cooling air introduced into the path of the filaments, said air contacting said filaments transverse, countercurrent and cocurrent in progressive order of their movement through said quenching zone, said air contacting the filaments at a volumetric rate of 100 to 800 cubic feet of air per pound of filaments entering the quenching zone.

The apparatus for carrying out the process of the present invention comprises a spinning unit comprising a spinning pump, a spinneret, and a spinning filter disposed between said pump and said spinneret, for extruding a plurality of filaments downwardly into a heated sleeve, the wall of said heated sleeve being imperforate and secured to the spinneret in an air-tight manner, said heated sleeve leading downwardly in an air-tight manner, said heated sleeve leading downwardly to a quenching chamber having an inlet and an outlet for allowing cooling air to pass through the chamber and means for regulating the stream of cooling air passing through said chamber whereby both the volumetric rate of the air stream and its general direction as it contacts the descending plurality of filaments may be regulated.

DESCRIPTION OF THE PREFERRED EMBODIMENT

Figure 1:
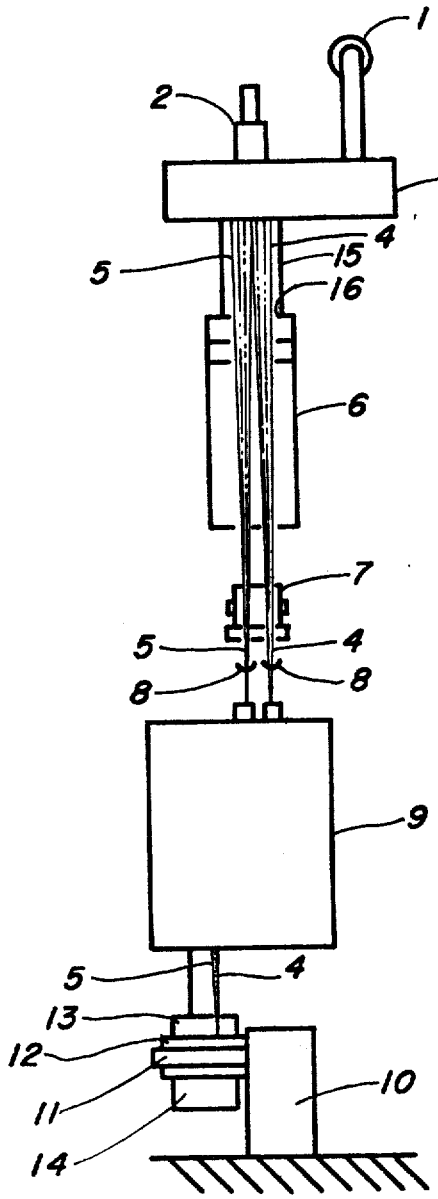
FIG. 1 is a schematic front view of the preferred apparatus used for the process of this invention.

It has now been found that synthetic multifilament yarn, e.g., polyethylene terephthalate multifilament yarn, including such yarn of high denier per filament, e.g., 20 to 50 denier per filament (undrawn) can be melt spun continuously at high production rates such as 50 to 90 pounds per hour, and this yarn can be continuously drawn without an intermediate step of winding up, at draw ratios of at least 4:1. These results are achieved in accordance with this invention, by employing a controlled quenching of the melt spun filaments under critical conditions whereby the coefficient of variation of the evenness of the yarn (U %) is not above 10. More specifically, in accordance with the present process, a relatively large number of heavy filaments are extruded downwardly into a substantially stationary column of air having a temperature of 100° to 330°C. and a height of from 0.5 to 2 feet, preferably 1 to 1.5 feet, immediately below the spinneret, the distance between adjacent filaments immediately below the spinneret being preferably 0.28 to 0.4 inch, and subsequently advancing the filaments through a quenching zone wherein they are contacted with cooling air entering the zone at a volumetric flow rate of 100 to 800, preferably 200 to 700 cubic feet of air (measured at standard temperature and pressure) per pound of entering filaments, the air being at inlet temperature preferably not above 35°C. Especially effective is a split flow of air in the cooling zone, said air contacting the filaments transverse, countercurrent, and cocurrent in progressive order of their movement through the quenching zone, whereby the temperature of said filaments is reduced to not over 55°C.

One preferred embodiment of this invention is directed to an improved melt spinning process and apparatus involving double-end spin-draw and take-up for multifilament synthetic polymer fibers. The accompanying drawings illustrate the preferred apparatus.

Figure 2:
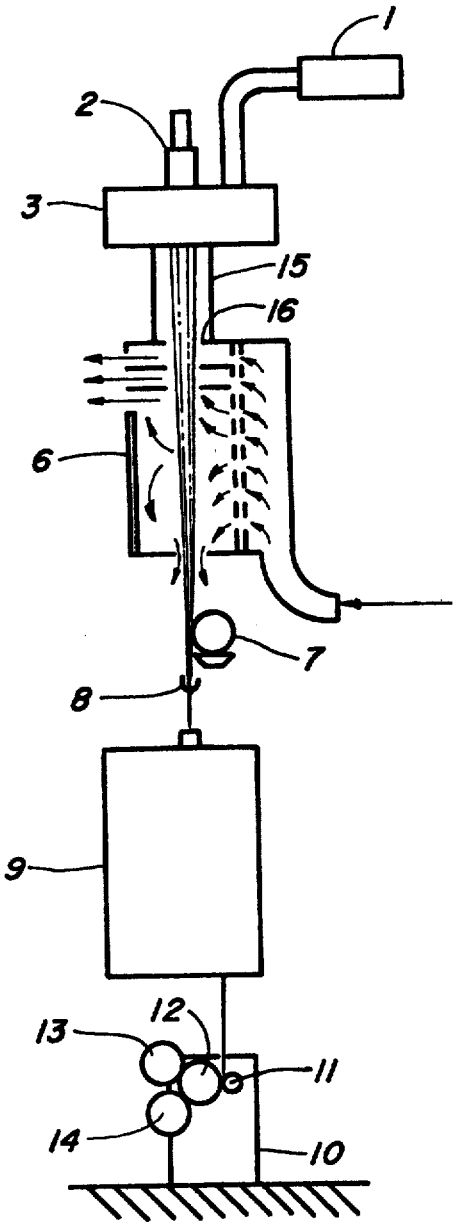
FIG. 2 is a schematic side view of the preferred apparatus used for the process of this invention.

Referring to FIGS. 1 and 2, like numbers indicate like apparatus. Molten polymer is fed by extruder 1 to spinning pump 2 which feeds spinning block 3 containing a conventional spinning pot, not shown, including a spinneret and a spinning filter disposed between said spinning pump and said spinneret. The spinning pot spinneret is divided into two parts by means of an undrilled stripe wide enough to form a visible stripe between the two multifilament continuous ends 4 and 5. Said multifilament continuous ends 4 and 5 are extruded from the spinneret at a rate of at least 50 pounds per hour, preferably 50–90 pounds per hour, and are passed downwardly through a heated sleeve 15 immediately below the lower part of the spinneret. The heated sleeve has a baffle 16 forming an inwardly extending flange at the end of the heated sleeve remote from the spinneret to minimize the flow of cooling air into the heated sleeve. The two multifilament continuous ends are cooled in quenching chimney 6 (described hereinafter and shown in FIG. 3), pass over finish roll 7 through two guides 8 to draw panel 9 (described hereinafter and shown in FIG. 4). Then the two ends, 4 and 5 pass to winder 10 through transverse guide, not shown, mounted on a cam in cam housing 11 which traverses the yarn across drive roll 12 which drives chucks 13 and 14 by surface driving a package of yarn. Each end is separately wound up on chucks 13 and 14.

Figure 3:
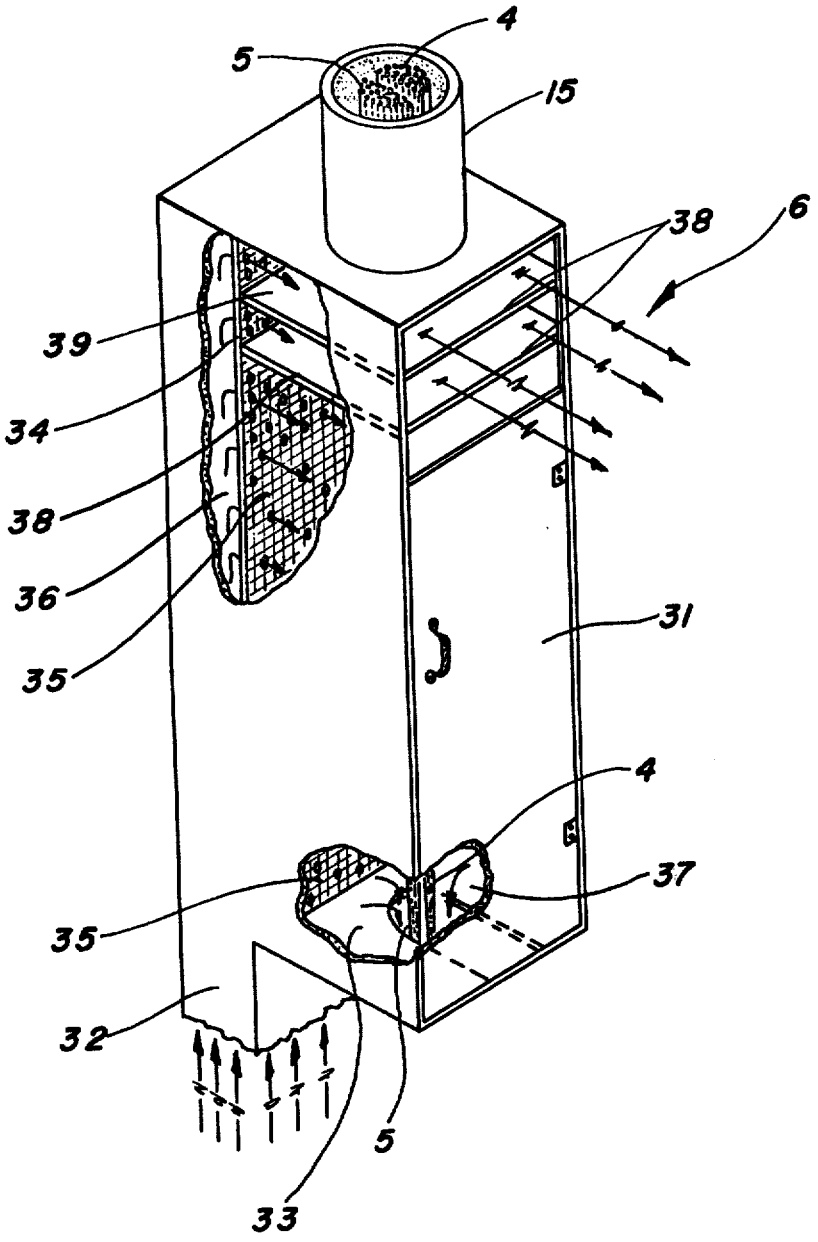
FIG. 3 is a perspective view of the quenching chimney labeled 6 in FIGS. 1 and 2, parts having been broken away to reveal details of construction.

As previously mentioned, FIG. 3 shows a preferred embodiment of quenching chimney 6 shown in FIGS. 1 and 2. The multifilament continuous ends 4 and 5 pass downwardly from the heated sleeve 15 through heated sleeve baffle 16 directly into the top of quenching chimney 6. Quenching chimney 6 is an elongated chimney at least 60 inches in height, preferably 60 to 80 inches in height, which is rectangular in cross-section and provided with imperforate top, rear, and side walls. The front of the chimney is partially covered by an imperforate door 31 which terminates short of the top of the wall and presents an open passage for air discharging from the chimney 6. At the lower rear side thereof, the quenching chimney 6 communicates with a duct 32 through which quenching air at substantially room temperature is introduced. The interior of quenching chimney 6 is partitioned by a perforated distribution plate 34 and a distribution screen 35, which forms the boundary between a plenum chamber 36, to which air is introduced from inlet duct 32, and a quenching chamber 37 through which the multifilament continuous ends 4 and 5 pass. In the top portion of quenching chamber 37 above door 31, provision is made for a plurality, preferably 2 to 5, parallel baffles 38 of shaped profile which form sections 39 intended to provide guided travel of the air stream transverse to the movement of the multifilament continuous ends 4 and 5 through said top portion of quenching chamber 37. The multifilament continuous ends 4 and 5 pass through the length of quenching chamber 37 and leave the quenching chamber, preferably through a shaped baffle 33 at the bottom of said chamber. The quenching air enters the plenum chamber 36 through duct 32, passes through distribution plate 34 and distribution screen 35 to the quenching chamber 37. The direction of air flow in quenching chamber 37 is indicated by arrows in FIG. 2 and FIG. 3. As shown by these arrows, the quenching air preferably contacts the filaments, transverse, countercurrent, and cocurrent in the progressive order of their movement through the quenching chamber 37. Preferably, 2 to 5 parallel baffles 38 are used; however the baffle requirement depends somewhat on the denier produced and the throughput as shown in the specific examples.

Figure 4:
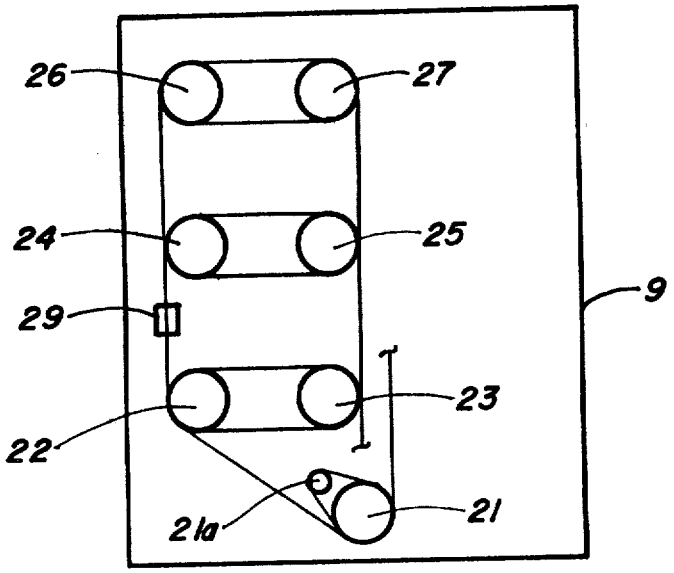
FIG. 4 is a schematic of a two end embodiment of the draw panel labeled 9 in FIGS. 1 and 2.

FIG. 4 shows the preferred embodiment for a two end embodiment for the draw panel 9 shown in FIGS. 1 and 2. Yarn passes from the quenching chimney 6 to a pretension roll 21 with its accompanying separator roll 21*a*, then into first feed roll pair Godet rolls 22 and 23, then through the draw point localizer 29 which can be a conventional heated pin or a steam jet, then to a draw roll pair of Godet rolls 24 and 25, then to a relaxation pair of Godet rolls 26 and 27 and optionally through an entangling apparatus such as a conventional steam or air operated interlacing jet, and on to winder 10 as shown in FIGS. 1 and 2.

It is important that the above-described process and apparatus of the present invention permits a significant increase in production capacity of a polymer spinning operation. In some cases, it is practical to convert a single-end fiber plant to double-end plant with only simple changes in the original equipment, the yarn production being increased for example by a factor of 2. Also, the present invention substantially overcomes problems of poor yarn quality such as the formation of loose filament loops and broken filaments. Further, the present invention greatly improves the mechanical quality problems of double-end spinning caused by fused, filaments and filament irregularity in undrawn filaments.

In order to demonstrate the invention, the following examples are given. They are provided for illustrative purposes only and are not to be construed as limiting the scope of the invention, which is defined by the appended claims. In these examples, parts and percentages are by weight unless otherwise indicated. The intrinsic viscosity of the polyester is given as a measure for the mean molecular weight, whcih is determined by standard procedures wherein the concentration of the measuring solution amounts to 0.5 g/100 ml., the solvent is a 60 percent phenol-40 percent tetrachloroethane mixture, and the measuring temperature is 25°C. In the examples, the diameter fluctuations along an unstretched bundle of filaments serve as a measure of uniformity. For high quality yarn, it is important that the filaments be substantially uniform. Accordingly, the coefficient of variation of the evenness (U %) is determined using an Uster evenness tester manufactured by the Zellweger Company of Uster, Switzerland and described in "Handbood of Textile Testing and Quality Control" by E. Groover and D. S. Hamby.

EXAMPLE 1

A melt of polyethylene terephthalate having an intrinsic viscosity of about 0.92 was supplied at a rate of 60 pounds per hour, at a temperature of about 291°C., to the apparatus shown in FIGS. 1 to 4. The molten polymer was fed by extruder 1 to spinning pump 2 which fed spinning block 3 containing a conventional spinning pot comprising a spinning filter and a spinneret, the spinning filter being disposed between the spinning pump and the spinneret. The spinning filter consisted of a conventional sieve filter combination of 24 metal screen layers. The pressure drop through said spinning filter averaged 200 to 400 atmospheres. The spinning pot was enclosed in a controlled high temperature atmosphere so that loss of heat from the polymer was minimized. The melt enthalpy increase through the pump and sieve filter was sufficient to heat the melt at a point immediately above the spinneret to about 305°–310°C., and the pressure at this point was about 50 atmospheres. The flow of polymer through the spinneret was maintained at a constant rate of 60 pounds per hour by spinning pump 2.

The spinning pot spinneret was divided into two parts by means of an undrilled "stripe" wide enough to form a visible split between the multiple ends below the spinneret. The spinneret was preferably positioned with respect to the quenching chimney 6 so that the stripe was parallel to the side walls of said chimney and therefore to the flow of cooling air through the top portion of said chimney. The spinneret plate had 384 holes (192 holes on each side of the undrilled stripe), each of 0.018 inch diameter, spaced so that the distance between the filaments formed was 0.28 to 0.40 inch immediately below the spinneret.

From said spinneret there was extruded two ends of multifilament, continuous filament yarn, and the two ends were passed downwardly into a substantially stationary column of air contained in a heated sleeve 15, about 15 inches in height, disposed surrounding and immediately beneath the spinneret. The air temperature in the heated sleeve was maintained at about 300°C. at the top of the sleeve, decreasing to about 115°C. at the bottom. The temperature of the metal in the heated sleeve was about 330°C. at the top and 220°C. at the bottom of the sleeve. The minimum distance between filaments at the bottom of the heated sleeve was about 0.24 inches. A heated sleeve baffle 16 was provided at the bottom of the heated sleeve forming an inwardly extending flange to minimize flow of cooling air into the heated sleeve.

Yarn leaving the heated sleeve was passed directly into the top of quenching chimney 6, shown in detail in FIG. 3. The quenching chimney was an elongated chimney 70 inches in height, substantially rectangular in cross-section and provided with imperforate top, rear and side walls. The front of the chimney was partially covered by an imperforate door 31 which terminated about 17.5 inches short of the top wall and presented an open passage for air discharging from the chimney. The interior of the quenching chimney was partitioned by a perforated distribution plate 34 and distribution screen 35, which formed the boundary between plenum chamber 36 and quenching chamber 37. Quenching air at about 25°C. and 65% relative humidity was supplied to plenum chamber 36 from inlet duct 32, at about 200 cubic feet of air per pound of filaments entering the quenching chamber 37.

The two ends of multifilament, continuous filament yarn were advanced downwardly through quenching chamber 37 wherein they were in contact with the cooling air introduced into the path of the filaments. Four horizontal parallel baffles 38 approximately 3 inches apart vertically and extending down about 12 inches from the top of quenching chamber 37 were used to provide transverse contact of the cooling air with the filaments in the top portion of the quenching chamber. In the middle portion of the quenching chamber below the horizontal baffles 38, the cooling air was deflected upward by imperforate door 31 and flowed substantially countercurrent to the movement of the filaments, said air leaving the quenching chamber via the opening above imperforate door 31. Part of the cooling air flowed out of the bottom of the quenching chamber with the filaments, and the air flow in the bottom zone of the quenching chamber was substantially cocurrent to the movement of the filaments. This novel quenching system increased quenching efficiency significantly as evidenced by air temperature and air velocity profiles. The number of horizontal stack baffles 38 required to obtain improved undrawn yarn quality was preferably 2 to 5 as shown in Example 2. The temperature of the cooled yarn at the bottom of quenching chamber 37 was about 50°C. In the present example, where polyester was supplied at 60 pounds per hour, 4 parallel horizontal baffles 38 gave high quality yarn; the coefficient of variation of the evenness of the undrawn yarn (U %) was not above 10 over an extended period of operation.

The two ends of cooled, multifilament continuous filament yarn were advanced downwardly, preferably through a shaped baffle 33 at the bottom of quenching chamber 37. The ends were separated by guides 8 located below a lubricating finish applicator 7. Following lubrication, the ends passed through a guide separation to pretension roll 21 with its accompanying separator roll **21*a*, shown in FIG. 4. The yarn was then passed over cold feed roll pair Godet rolls 22 and 23, then through a draw point localizer which was a conventional steam jet, then to a draw roll pair of Godet rolls 24 and 25 operated at about 145°C. and traveling at a speed 5.0 to 6.6 times faster than the feed roll, then to a relaxation pair of Godet rolls 26 and 27, and optionally through an entangling apparatus such as a conventional air operated interlacing jet, and on to winder 10 to shown in FIGS. 1 and 2. Typical yarn prepared at a draw ratio of 6** had the following properties:

| | |
|---|---|
| Denier | 1,000 |
| Tenacity, g/d | 9.25 |
| Elongation, % | 13.5 |
| Shrinkage, % | 9.5 |

It will be understood that the above-described draw panel can be modified if desired. For example, the yarn may be drawn on a seven roll panel or on a four roll panel. However, regardless of panel set up, the draw panel process steps involve pretensioning to provide yarn stability on the rolls and on entry of the yarn into the draw point localizer steam jet, feed rolls to provide constant yarn supply to the draw zone, a draw point localizer to provide draw-down point in the draw zone, draw rolls to maintain constant draw ratio and relax rolls to provide for control of yarn physical properties. Optionally, a yarn compaction jet may be used before or after the relax rolls to provide yarn entanglement.

EXAMPLE 2

A series of tests were carried out to produce yarn using the process and apparatus for Example 1 but modifying various factors to show the criticality of the process and apparatus elements required to produce high quality yarn, particularly yarn wherein the coefficient of variation of the evenness of the undrawn yarn (U %) is not above 10. Most important effect noted was the interaction effect resulting when the cooling air introduced into the path of the filaments contacts the filaments transverse, countercurrent and cocurrent in progressive order of their movement through the quenching chamber. With use of the preferred apparatus, the air flow was easily controlled by adjusting the height and position of the imperforate door 31 and the number and position of the parallel baffles 38 at the top portion of quenching chamber 37. Particularly desirable results were obtained by a combination wherein the imperforate door 31 blocked 70–80%, preferably about 75% of the lower part of the front of the quenching chamber 2 to 5 horizontal baffles 38 were used in the top portion of the quenching chamber. The following table indicates the criticality of various elements. In these tests, the standard deviation ($\sigma$) of the Uster value (U %) was about 1.0%, and a difference of 3% or more between values is significant at greater than the 99% level.

TABLE I

Quenching Chamber Trials
(1,000 Denier Yarn at 60 Pounds/Hour Throughput)

| Number of Baffles (Heated Sleeve Baffle Used) | Door Blockage | Uster Value (U %) |
|---|---|---|
| None | Lower 75% | 25 |
| 1 | Lower 75% | 14 |
| 2 | Lower 75% | 9 |
| 3 | Lower 75% | 9 |
| 4 | Lower 75% | 8 |
| 5 | Lower 75% | 8 |
| None | Lower 75% | 24 |
| None | Open | 14 |
| None (with Heated | Lower 75% | 31 |

TABLE I-continued

Quenching Chamber Trials
(1,000 Denier Yarn at 60 Pounds/Hour Throughput)

| Number of Baffles (Heated Sleeve Baffle Used) | Door Blockage | Uster Value (U %) |
|---|---|---|
| Sleeve Baffle Removed) | | |

These data show that improved yarn (low U%) resulted when the heating sleeve baffle was used, the lower 75% of the front of the quenching chamber was blocked, and 2 to 5 horizontal baffles 38 were used in the top portion of the quenching chamber. In additional tests, similar results were shown for 1,000 denier yarn at 53 pounds/hour throughput. For 1,000 denier and 1,300 denier yarn at 80 pounds/hour throughput, optimum Uster (U %) was obtained using 4 baffles located 3, 6, 12 and 18 inches from the top of the quenching chamber with a baffle 33 at the bottom of the quenching chamber. This same baffle arrangement was also applicable to 1,000 and 1,300 denier yarns at lower throughputs.

EXAMPLE 3

The apparatus shown in FIGS. 1 and 2 supplied 60 pounds/hour e-polycaprolactam to a spinning pot enclosed in a controlled high temperature environment. The spinning pot spinneret was divided into two parts by means of an undrilled stripe wide enough to form a visible split between the multiple ends below the spinneret. The average distance between adjacent filaments immediately below the spinneret was 0.28 to 0.4 inch. The ends were advanced downwardly through a substantially stationary column of air maintained at 100° to 330°C. in heated sleeve 15. The ends were then advanced downwardly through quenching chimney 6 wherein they were contacted with cooling air introduced into the path of the filaments, said air at 25°C. contacting the filaments transverse, countercurrent and cocurrent in progressive order of their movement through the quenching chimney 6. The air contacted the filaments at a volumetric rate of about 200–300 cubic feet of air per pound of filaments entering the quenching chimney 6. The ends were separated by guides 8 located below a finish applicator 7. After lubrication, the ends passed through a guide separation and onto a heated feed roll and accompanying idler roll. Feed roll temperature was maintained at 80 ± 10°C. The yarn ends were then passed around a first stage draw roll and accompanying idler roll at a peripheral speed 2.5–4.0 greater than the feed roll. The draw roll temperature was kept below 50°C. (Optionally a heated draw pin at 65°–85°C. is placed between the feed and first stage draw rolls.) The yarn ends were then directed to a draw point localizer. The ends were then passed around a heated roll and accompanying idler roll at 125°–210°C., which operated at a peripheral speed 1.4–2.3 times that of the first stage draw roll. The yarn was then taken up on a multi-end winder.

DISCUSSION

In additional tests, we have shown that conventional crossflow quenching of polyester and polyamide yarn is satisfactory for relatively low filament counts of say less than 200 filaments and relatively low throughputs of less than 35 pounds per hour through the spinneret.

However, for increased production capacity, e.g., 50 to 90 pounds per hour through the spinneret, and particularly for double-end production requiring a total of for example 380–400 filaments, standard quenching was found inadequate as indicated by fused filaments and poor filament uniformity. We have found that the quenching chamber baffles described in the present disclosure when used in combination with a heated sleeve baffle and a partially blocked quenching chamber door, gave the improved quenching efficiency required. Blocking the door of the quenching chamber below the baffled area forced a much greater percentage of cooling air to be carried through the yarn in the zone just below the heated sleeve removing more heat, causing the yarn to be blown in a steady arch, and permitting higher air rates while improving yarn quality. Major advantages gained by the present invention include improved filament uniformity, elimination of fused filaments, improved air velocity profiles and improved quench air temperature profiles. Smoke tests were utilized to show that as the filaments were advanced downwardly through the quenching zone, the cooling air contacts said filaments transverse, countercurrent, and cocurrent in progressive order of their movement through the quenching zone.

The present invention is particularly useful for economical production of polyamide and polyester tire and industrial yarn. By "polyamide" is meant the polymers made by condensation of diamines with dibasic acids or by polymerization of lactams or amino acids, resulting in a synthetic resin characterized by the recurring group —COHN—. The preferred polyesters are the linear terephthalate polyesters, i.e., polyesters of a glycol containing from 2 to 20 carbon atoms and a dicarboxylic acid component containing at least about 75% terephthalic acid. The remainder, if any, of the dicarboxylic acid component may be any suitable dicarboxylic acid such as sebacic acid, adipic acid, isophthalic acid, sulfonyl-4,4′-dibenzoic acid, or 2,8-dibenzofuran-dicarboxylic acid. The glycols may contain more than two carbon atoms in the chain, e.g., diethylene glycol, butylene glycol, decamethylene glycol, and bis-1,4-(hydroxymethyl) cyclohexane. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5-[sodium sulfo]isophthalate) (97/3), poly(cyclohexane-1,4-dimethylene terephthalate), and poly(cyclohexane-1,4-dimethylene terephthalate/hexahydroterephthalate) (75/25).

We claim:

1. An apparatus for the production of a synthetic multifilamentary yarn having uniform quality at a production rate of at least 50 pounds per hour, from a high-molecular weight thermoplastic polymer, selected from the group consisting of linear polyester and polyamide polymers, by melt spinning, comprising a spinning unit which comprises a spinning pump, a spinneret, and a spinning filter disposed between said pump and said spinneret, for extruding a plurality of filaments downwardly into a heating sleeve having a height of 0.5 to 2 feet, the wall of said heated sleeve being imperforate and secured to the spinneret in an air-tight manner, said heated sleeve having a baffle forming an inwardly extending flange at the end of the heated sleeve remote from the spinneret, said heating sleeve leading downwardly to a rectangular quenching chamber at least 60 inches in height, having opposite, essentially vertical inlet and outlet panels for allowing cooling air to pass through the chamber and means for regulating the stream of cooling air passing through said chamber whereby both the volumetric rate of the air steam and its general direction as it contacts the descending plurality of filaments may be regulated, the top portion of said chamber having 2 to 5 parallel baffles which form sections intended to provide guided travel of the cooling air transverse to the movement of the filaments, the outlet panel of said chamber being partially covered by an imperforate door which terminates short of the top of said chamber and presents an open passage for the air discharging from said chamber, said door in combination with said parallel baffles in the top portion of said chamber providing guided travel of the cooling air, whereby said cooling air contacts the filaments transverse, countercurrent and cocurrent in progressive order of their movement through the quenching chamber.

2. The apparatus of claim 1 wherein the spinneret is divided into two parts by means of an undrilled stripe wide enough to form a visible split between the two ends of multifilament, continuous filament yarn extruded from said spinneret.

3. The apparatus of claim 2 wherein said undrilled stripe in said spinneret is parallel to the flow of cooling air through the top portion of said rectangular quenching chamber.

4. The apparatus of claim 3 wherein the top portion of the quenching chamber has 4 parallel baffles located 3, 6, 12 and 18 inches from the top of said quenching chamber.

* * * * *

UNITED STATES PATENT OFFICE
CERTIFICATE OF CORRECTION

PATENT NO. : 3,936,253
DATED : February 3, 1976
INVENTOR(S) : William Bernard Fisher et al.

It is certified that error appears in the above-identified patent and that said Letters Patent are hereby corrected as shown below:

Column 5, line 3, omit "," after "fused".

Column 5, line 12, change "whcih" to --which--.

Column 7, line 5, change "to" to --as--.

Column 10, line 11, change "heating" to --heated--.

Column 10, line 16, change "heating" to --heated--.

Column 10, line 22, change "steam" to --stream--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*